US006127776A

United States Patent [19]

Dasgupta

[11] Patent Number: 6,127,776

[45] Date of Patent: Oct. 3, 2000

[54] METHOD AND APPARATUS FOR SECURING A DEFLECTION YOKE TO A CATHODE RAY TUBE

[75] Inventor: Basab Bijay Dasgupta, Escondido, Calif.

[73] Assignees: Sony Corporation, Toyko, Japan; Sony Electronics, Inc., Park Ridge, N.J.

[21] Appl. No.: 09/099,438

[22] Filed: Jun. 18, 1998

[51] Int. Cl.[7] ..... H01J 29/70

[52] U.S. Cl. ..... 313/440; 445/45; 348/829; 348/830

[58] Field of Search ..... 313/430, 438, 313/440, 441, 442; 348/828, 829, 830, 831; 445/45

[56] References Cited

U.S. PATENT DOCUMENTS

| | | | |
|---|---|---|---|
| 4,554,589 | 11/1985 | Cormio | 358/248 |
| 4,620,127 | 10/1986 | Chung et al. | 313/440 |
| 4,687,966 | 8/1987 | Carroll et al. | 313/440 |
| 4,786,973 | 11/1988 | Lock et al. | 358/248 |
| 5,408,277 | 4/1995 | Strijbos et al. | 348/831 |
| 5,416,595 | 5/1995 | Wield | 348/825 |

*Primary Examiner*—Kenneth J. Ramsey
*Assistant Examiner*—Michael J. Smith
*Attorney, Agent, or Firm*—Ronald P. Kananen; Rader, Fishman & Grauer

[57] ABSTRACT

A method and apparatus for securing a deflection yoke onto a cathode ray tube includes forming pockets having deformable, resilient inner walls along a circumferential surface of the deflection yoke. When the deflection yoke is mounted on the cathode ray tube, the inner walls deform slightly to conform to a contact portion of the cathode ray tube. The position of the deflection yoke with respect to the cathode ray tube it then adjusted into proper alignment. Once the deflection yoke and cathode ray tube are properly aligned, fast curing epoxy is poured into each of the plastic pockets, wedging the deflection yoke permanently into its desired orientation on the cathode ray tube. The pockets can either be integrally formed with the deflection yoke or they can be manufactured and attached to the deflection yoke in a separate operation.

18 Claims, 3 Drawing Sheets

METHOD AND APPARATUS FOR SECURING A DEFLECTION YOKE TO A CATHODE RAY TUBE

TECHNICAL FIELD

The present invention is directed to an integrated tube construction having a cathode ray tube and an attached deflection yoke. More particularly, the invention relates to a method and apparatus for permanently fixing the desired orientation of a deflection yoke on a cathode ray tube.

BACKGROUND ART

Cathode ray tubes (CRT's) are used as displays for television sets and computers. To generate a display picture, an electron beam scans across a phosphor screen, causing the phosphors in the screen to emit various colors of visible light. In many cases, a deflection yoke is used to deflect the electron beam through a scanning pattern.

As shown in FIG. 1*a*, a conventional deflection yoke 10 has a funnel shape for mating with a CRT 12. The CRT 12 has a neck portion 14 that fits inside a corresponding neck portion 16 of the deflection yoke. Both the neck 16 of the deflection yoke 10 and the neck 14 of the CRT 12 have a generally frusto-conical shape, but the conical shape of the deflection yoke's neck 16 is somewhat shallower and wider to allow adjustment of the yoke's 10 position with respect to the CRT 12. Thus, when the deflection yoke 10 is placed on the outside of the CRT 12, it can be adjusted in both the vertical and horizontal directions while still remaining around the CRT 12. Once the optimum deflection yoke 10 position with respect to the CRT 12 is achieved, the deflection yoke's 10 position must be fixed to ensure that its orientation with respect to the CRT 12 is permanent.

The most common method for fixing the deflection yoke's 10 position is by inserting hard rubber wedges 18 in between the CRT 12 and the deflection yoke 10, shown in FIG. 1*b*. Because the wedges 18 often must be inserted manually, the process is quite inefficient and slow by today's manufacturing standards. In addition, it is quite difficult to maintain ideal deflection yoke 10 alignment on the CRT 12 using this method because the insertion of one wedge 18 could cause the deflection yoke 10 to shift slightly with respect to the CRT 12, possibly placing the deflection yoke 10 at a less than an optimal position once all of the wedges 18 are inserted.

Another proposed solution is to form openings in a separator of the deflection yoke and push plastic slides through the openings (not shown), but this presents many of the same problems as the method using rubber wedges 18. Further, it has the added disadvantages and costs associated with creating plastic slides that fit precisely into the openings in the deflection yoke separator to ensure that the deflection yoke 10 does not shift on the CRT 12 after assembly.

To create a more precise fit between the CRT 12 and the deflection yoke 10, some manufacturers inject an adhesive or a liquid polymer 19, such as glue or epoxy, in between the CRT 12 and the deflection yoke 10, as shown in FIG. 1*c*. The adhesive fills and conforms to the shape of the space in between the CRT 12 and deflection yoke 10, ensuring a tight seal once the adhesive 19 dries or is cured. Although this construction virtually guarantees permanent fixing of the yoke 10 on the CRT 12, the amount of adhesive 19 used makes this method somewhat messy and expensive.

It is therefore an object of the invention to construct a CRT/deflection yoke assembly that reliably holds the position of a deflection yoke on a CRT in a desired fixed position while minimizing the mess and cost associated with conventional adhesive-based assemblies.

SUMMARY OF THE INVENTION

Accordingly, the present invention is directed to a method and apparatus for securing a deflection yoke to a CRT wherein the deflection yoke has at least one pocket placed along a circumferential surface of the yoke. The pockets each have a deformable inner wall made of a flexible, resilient material. The inner wall is designed to rest against a neck portion of the cathode ray tube and deform as the position of the deflection yoke is adjusted for optimal alignment, molding itself somewhat to the contact surface of the CRT. Once the CRT is in a desired position, the pockets are filled with a fast-curing epoxy or similar material, creating custom-formed "wedges" that hold the CRT securely and permanently in place.

The pockets themselves can either be formed integrally with the deflection yoke or they can be manufactured in a separate process and then affixed to the deflection yoke. Further, multiple pockets could be spaced around the circumference of the deflection yoke, or alternatively a single circular pocket could be formed around the yoke's circumferential surface, almost in the shape of a trough. The present invention thereby offers the benefits of an epoxy seal with the convenience of wedges while reducing the mess and expense associated with epoxy seals.

DETAILED DESCRIPTION OF THE PREFERRED EMBODIMENTS

Figure 1A:
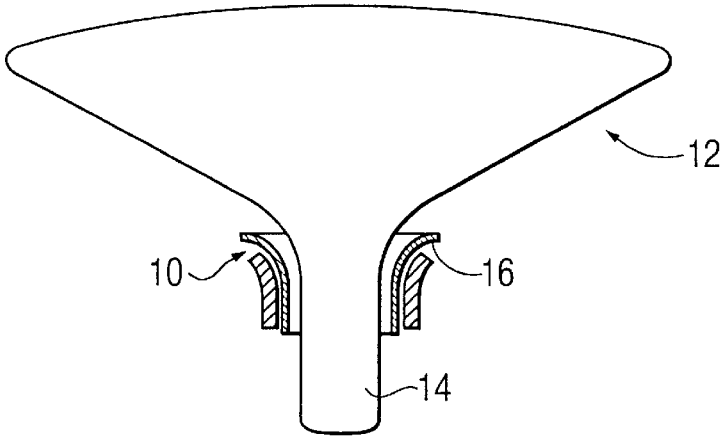
FIG. 1a (PRIOR ART)
FIG. 1*a* through 1*c* are diagrams showing the general structure of a conventional deflection yoke and cathode ray tube.
Figure 1B:
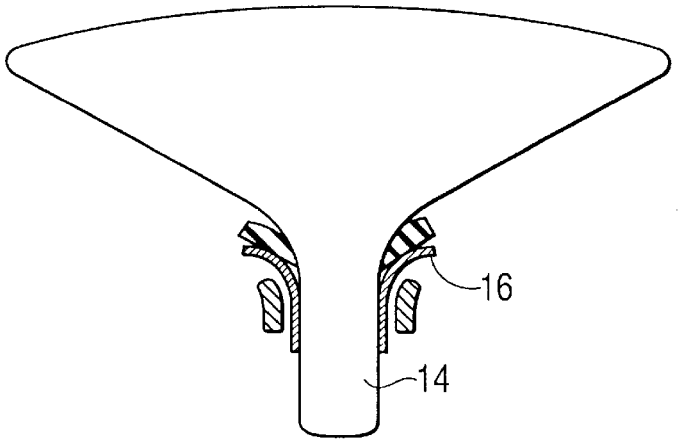
FIG. 1b (PRIOR ART)
Figure 1C:
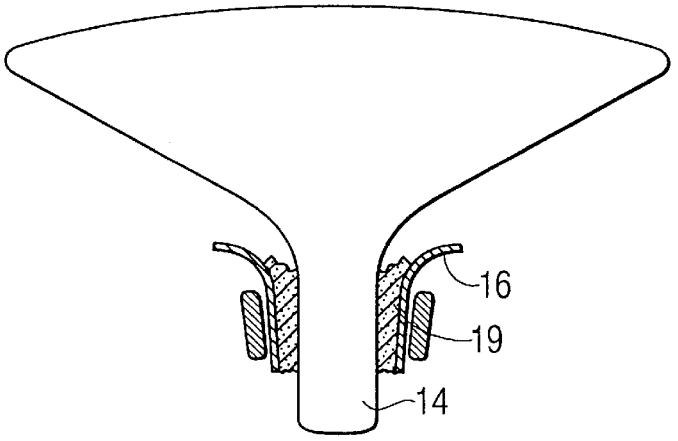
FIG. 1c (PRIOR ART)
Figure 2:
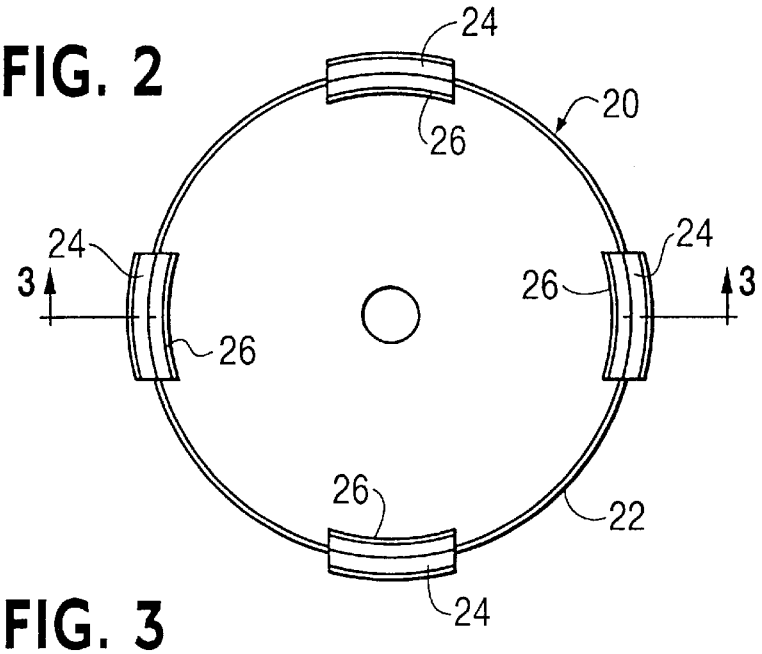
FIG. 2 is a front view of the deflection yoke of the present invention.
Figure 5:
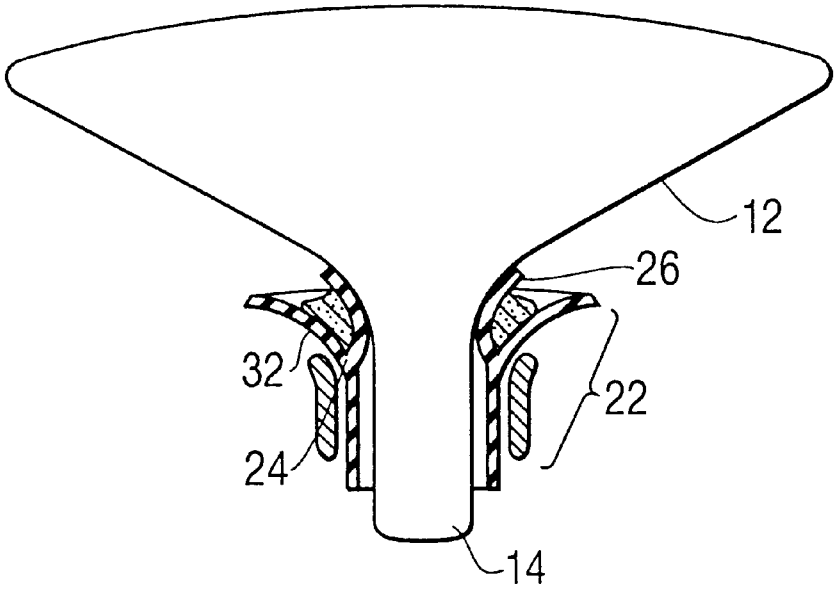
FIG. 5 shows the deflection yoke of the invention yoke after the CRT/yoke assembly has been completed.

Referring to FIG. 2, a deflection yoke 20 of the present invention has a circumferential surface 22 having a plurality of pockets 24 spaced along the surface 22. The pockets will eventually be used for receiving epoxy or some other firm-setting material to hold the deflection yoke 20 in place once it is properly aligned on the CRT. Each of the pockets 24 have a flexible inner wall 26, which is made of a resilient material, for contacting a contact portion 27 of the CRT's 12 surface and generally conforming to the shape of the surface 27 thereof, as shown in FIG. 5.

The contact portion 27 of the CRT 12 is preferably around the neck area of the CRT 12, but any other portion that allows stable positioning of the deflection yoke 20 on the CRT 12 is acceptable. The flexible inner walls 26 slightly deform as the deflection yoke's 20 position is adjusted on the CRT, but the walls 26 are also resilient so that they do not lose contact with the CRT's surface 27 if the position of the deflection yoke 20 changes.

Figure 3:
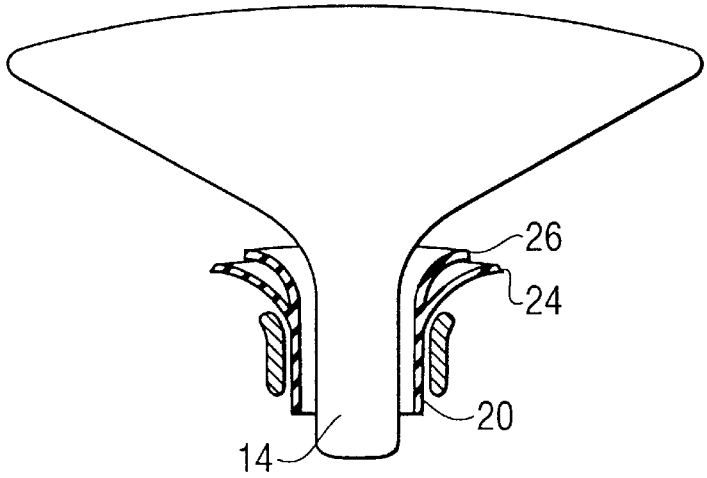
FIG. 3 is a cross-sectional view taken along line 3'—3' of the deflection yoke of FIG. 2.

FIG. 3 shows a cross-sectional view of the deflection yoke 20 taken along line 3'—3' of FIG. 2. The CRT 12 is also shown in FIG. 3 with the deflection yoke 20 in this figure to illustrate the relative positions of the CRT 12 and the deflection yoke 20. As shown in the figure, the flexible walls 26 of the pockets 24 generally conform to a surface of the CRT 12, even if the orientation of the deflection yoke 20 with respect to the CRT 12 is changed during adjustment. Further, the depth and shape of the pockets 24 can vary depending on where they are positioned on the circumferential surface 22 of the deflection yoke 20.

The pockets 24 can be integrally formed with the deflection yoke 20 by adjusting the dimensions of the inner flexible walls 26 so they have the requisite flexibility and resilience for conforming generally to the contact surface of the CRT 12. This streamlines the manufacturing process by constructing the pockets 24 and the deflection yoke 20 in the same manufacturing step. Alternatively, the pockets 24 could be manufactured in a separate process and then attached to the deflection yoke 20 using any known appropriate attachment process. Separate manufacture of the pockets 24 allows the pockets 24 and the deflection yoke 20 to be made of different materials, creating a greater number of design options.

Figure 4:
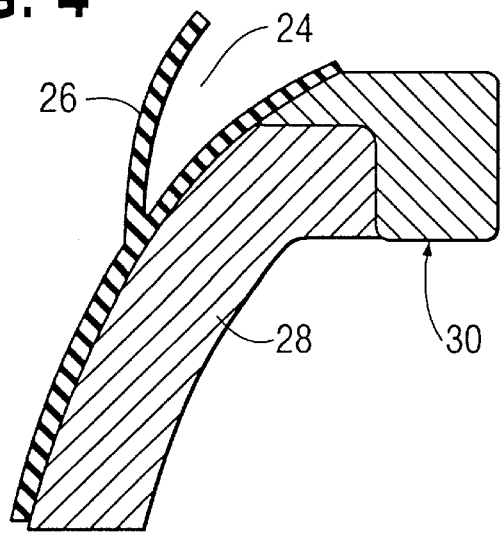
FIG. 4 is a close-up cross-sectional view taken along line 3'—3' of the deflection yoke of FIG. 2.

FIG. 4 shows a close-up view of one of the pockets illustrated in FIG. 3 and its relationship with other components of the deflection yoke 20. The deflection yoke 20 includes a coil 28 and a separator 30. The pocket 24 is positioned over the coil 28 such that a portion of the coil 28 is located in between the pocket 24 and the separator 30.

Referring now to FIG. 5, once the deflection yoke 20 has the desired orientation with respect to the CRT 12, epoxy or another quick-hardening material 32 is poured into each of the pockets 24. Once the epoxy 32 hardens, the inner walls 26 of the pockets 24 maintain whatever shape they held at the time the epoxy 32 was poured, wedging the yoke 20 permanently into the desired orientation with respect to the CRT 12.

The epoxy 32 can be poured into the pockets using any known epoxy dispenser, and the quantity of epoxy 32 poured into each of the pockets 24 can be pre-measured to minimize waste and reduce the possibility of overflow. The preferred process for creating the CRT/deflection yoke assembly includes sliding the deflection yoke 20 upward onto the CRT 12 from the bottom of the CRT 12 before the orientation of the yoke 20 is adjusted and the yoke 20 is secured in place by the epoxy 32.

Figure 6:
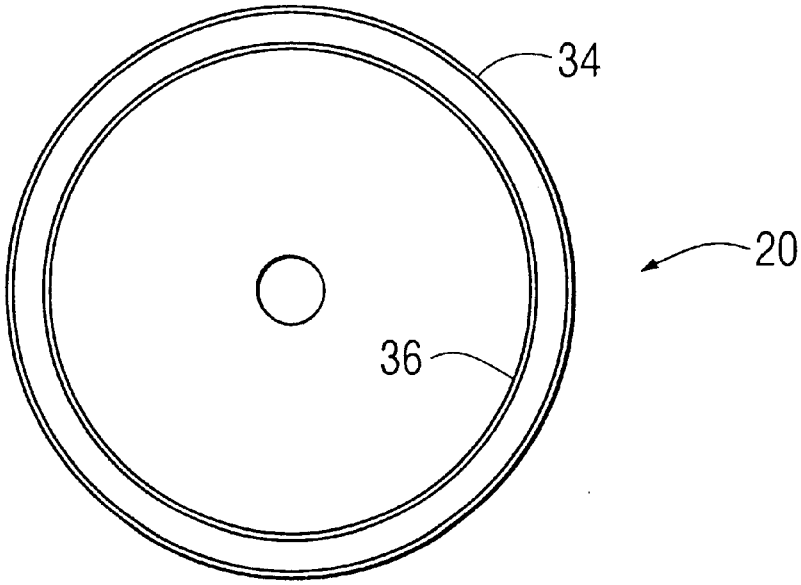
FIG. 6 shows the top view of a deflection yoke according to another embodiment of the invention.

FIG. 6 shows an alternative embodiment of the present invention. Instead of using a plurality of pockets 24 spaced around the circumferential surface 22 of the deflection yoke 20', a single circular pocket 34 could be formed such that it extends along the entire circumference of the deflection yoke 20'. The circular pocket 34 has a single circular flexible inner wall 36 for contacting the contact surface 27 of the CRT 12, creating a pocket 34 that is generally shaped as a toroidal trough. Epoxy can then be filled either at selected locations in the pocket 34 or in the pocket 34 along its entire circumference. This embodiment allows the inner wall 36 of the deflection yoke to contact a larger surface area of the CRT 12.

It should be understood that various alternatives to the embodiments of the invention described herein may be employed in practicing the invention. It is intended that the following claims define the scope of the invention and that the methods and apparatus within the scope of these claims and their equivalents be covered thereby.

What is claimed is:

1. An apparatus for securing a deflection yoke to a cathode ray tube, comprising:

at least one pocket along a circumferential surface of said deflection yoke, the pocket having a resilient inner wall made of a resilient material that contacts a contact surface of the cathode ray tube when the deflection yoke is placed onto the cathode ray tube such that the inner wall generally conforms to the contact surface;

a liquid material placed inside said at least one pocket, wherein the liquid material hardens into a solid material to maintain the conformity of the inner wall with the contact surface of the cathode ray tube.

2. The apparatus of claim 1, wherein the contact portion of the cathode ray tube is a neck portion of the cathode ray tube.

3. The apparatus of claim 1, wherein the deflection yoke comprises a plurality of pockets spaced along the circumferential surface, each pocket having the resilient inner wall.

4. The apparatus of claim 1, wherein the deflection yoke comprises one circular pocket extending along the circumferential surface, the circular pocket having a circular resilient inner wall.

5. The apparatus of claim 1, wherein the pocket is integrally formed with the deflection yoke.

6. The apparatus of claim 1, wherein the pocket is formed separately from the deflection yoke and attached to the deflection yoke.

7. The apparatus of claim 6, wherein the pocket and the deflection yoke are made from different materials.

8. The apparatus of claim 1, wherein the liquid material is a fast curing epoxy.

9. The apparatus of claim 1, wherein all of said liquid material is retained within said at least one pocket.

10. A method for securing a deflection yoke to a cathode ray tube, comprising:

forming at least one pocket along a circumferential surface of the deflection yoke, the pocket having a resilient inner wall for contacting a contact portion of the cathode ray tube;

placing the cathode ray tube inside the deflection yoke such that the contact portion of the cathode ray tube contacts the resilient wall of at least one pocket of the deflection yoke;

filling at least one of said pockets with a liquid material; and allowing the liquid material to harden into a solid material to maintain the conformity of the inner wall with the contact portion of the cathode ray tube.

11. The method of claim 10, further comprising adjusting the orientation of the cathode ray tube, thereby deforming the resilient wall of at least one pocket.

12. The method of claim 10, wherein the pocket is formed as a circular pocket extending along the circumferential surface of the deflection yoke, and wherein the resilient wall is also formed as a circular resilient wall extending along the circumferential surface of the deflection yoke.

13. The method of claim 10, wherein the forming step includes forming at least one pocket integrally with the deflection yoke.

14. The method of claim 10, wherein the forming step includes:

forming at least one pocket separately from the deflection yoke; and attaching at least one separately formed pocket to the circumferential surface of the deflection yoke.

15. The method of claim 10, wherein the liquid material used in the filling step is fast curing epoxy.

16. The method of claim 10, wherein the placing step includes sliding the deflection yoke upward onto the cathode ray tube from a narrow end of a neck portion of the cathode ray tube.

17. The method of claim 10, further comprising retaining all of said liquid material within said at least one pocket.

18. A method for securing a deflection yoke to a cathode ray tube, comprising inserting a liquid material into at least one pocket provided on an inner surface of said deflection yoke, where the deflection yoke is disposed on said cathode ray tube and a flexible wall of said pocket conforms to a surface of said cathode ray tube, wherein, when said liquid material hardens into a solid material, the solid material maintains an orientation of said deflection yoke with respect to said cathode ray tube.

* * * * *